United States Patent [19]

Nishio et al.

[11] Patent Number: 4,850,575

[45] Date of Patent: Jul. 25, 1989

[54] APPARATUS FOR MANUFACTURING A SINTERED BODY WITH HIGH DENSITY

[75] Inventors: Hiroaki Nishio; Takeshi Kawashima, both of Tokyo, Japan

[73] Assignee: Nippon Kokan Kabushiki Kaisha, Tokyo, Japan

[21] Appl. No.: 202,716

[22] Filed: Jun. 3, 1988

[30] Foreign Application Priority Data

Jun. 12, 1987 [JP] Japan ..... 62-145325

[51] Int. Cl.[4] ..... B22F 3/16

[52] U.S. Cl. ..... 266/149; 266/207; 373/112

[58] Field of Search ..... 266/149, 207, 208; 373/112; 432/13, 67, 68; 110/216; 425/78

[56] References Cited

U.S. PATENT DOCUMENTS

| | | | |
|---|---|---|---|
| 3,654,374 | 4/1972 | Scheyer | 373/112 |
| 4,268,708 | 5/1981 | Smith, Jr. et al. | 373/112 |
| 4,398,702 | 8/1983 | Lueth | 266/208 |

OTHER PUBLICATIONS

"Moldless Hot Press for Sintering and Hiping"; p. 404, Metal Powder Report, Jul. 1983.

*Primary Examiner*—Robert McDowell

*Attorney, Agent, or Firm*—Frishauf, Holtz, Goodman & Woodward

[57] ABSTRACT

An apparatus for manufacturing a sintered body with high density comprises: a table having an object to be processed laid thereon; a pressure vessel accommodating a heat element heating the object around and a heat-insulating mantle surrounding the heat element; supply device for supplying to the pressure vessel an extractant which extracts a binder or a dispersion medium contained in the object, exhaust device for exhausting the extractant and an extracted substance from the pressure vessel; pressure device for raising a pressure in the pressure vessel, and vacuum means for evacuating the pressure vessel. The apparatus enables carrying out the three steps of drying or degreasing, sintering and hot isostatic pressing of the object once put in the pressure vessel without handling the object outside the vessel. The object is formed as a compact in the preprocess in advance of being put in the apparatus.

16 Claims, 1 Drawing Sheet

APPARATUS FOR MANUFACTURING A SINTERED BODY WITH HIGH DENSITY

BACKGROUND OF THE INVENTION

1. Field of the Invention

The present invention relates to an apparatus for manufacturing a sintered body with high density, and more particularly to a structure of an apparatus for applying hot isostatic pressing.

2. Description of the Prior Arts

As a method of manufacturing a metallic or ceramic sintered body with high density by making use of metallic or ceramic powders as starting materials, a method is well known wherein those starting materials are firstly sintered into a sintered body, and then, hot isostatic pressing is applied to the sintered body. In advance of the sintering and the hot isostatic pressing, the starting materials are preprocessed to be formed into a compact. The method of the formation is generally classified into three types.

(a) Press forming method: Material powders are firstly put together with a dispersion medium into a ball mill, and then, agglomerated lumps thereof or original grains thereof are crushed, while mixed with the dispersion medium. Subsequently, to these crushed materials, a binder composed mainly of wax is added, and those materials are put into a spray drying process to extract the dispersion medium therefrom, thereby granulated powders being formed. The granulated powders thus obtained are press-formed, for example, by means of hydraulic forming, into a compact. This compact is degreased through a degreasing process. This degreasing process is carried out by a method wherein the binder and the dispersion medium included in the compact is evaporated or pyrolyzed, for example, by means of vacuum heating and to be removed outside in the form of gas.

(b) Casting method: Material powders together with a liquid dispersion medium are firstly put into a mixing tank equipped with a stirrer, and the material powders are mixed with the dispersion medium to be formed into slurry. The slurry is cast into a mold made of water-absorptive material such as gypsum and the dispersion medium is absorbed in the mold, to thereby give a feature of maintaining the shape to the slurry. Subsequently, the mold is demolded to obtain a compact. Another method is also known wherein a mold made of non-water-absorptive and well heat conductive material such as metal is cooled in advance and the slurry is cast into the mold to give the shape-maintaining feature to the slurry by means of freezing the dispersion medium. Subsequently, the mold is demolded to obtain a compact. In this method, no binder is used, and therefore, the degreasing process is needless, but, in stead, a dispersion medium existing in voids among grains constituting the compact is removed in the drying process following the casting step.

(c) Plastic forming method: Material powders together with a binder are put into a kneader to form pellets. The pellets thus kneaded are charged into a molding machine to form a compact with a predetermined shape. The compact is transferred to a degreasing process, which is ordinarily carried out by heating.

As clearly understood from the aforementioned, sintering and hot isostatic pressing thereafter cannot be applied to the compact until the compact has been prepared through a lot of series of the pretreating processes. In the hot isostatic pressing process, a sintered body formed from the compact is compressed by high pressure nitrogen or argon gas and the sintered body has come to be of the theoretical density or in the vicinity thereof. Thus, a sintered body with high density can be obtained.

The disadvantages pointed out of the aforementioned manufacturing methods are that three steps of degreasing or drying, sintering and hot isostatic pressing, each, are carried out, by independent process equipment, and therefore, transference of a compacted body is required every time the steps are shifted. This results in affecting unfavorably improvement of production efficiency, and being in danger of impairing quality of products because the compact is exposed to the air.

As a means for overcoming these difficulties, for example, in the technical journal "Metal Powder Report", July, 1983, P.404, an apparatus is disclosed, wherein the three steps of degreasing or drying, sintering and hot isostatic pressing can be carried out in vacuum, hydrogen or other gaseous atmospheres without handling a compacted body in a step-to-step transference, and this apparatus has been successfully applied to sintered hard alloy. This method can be applied to the press forming method mentioned in (a), because a mixed ratio of a binder in the pretreating process is so small that the degreasing step does not take so much time. But, this method is not applicable to both of the casting and the plastic forming methods mentioned in (b) and (c). This is because heating employed in the casting method requires 20 to 100 hours to remove a dispersion medium without producing cracks of the compact, and heating employed in the plastic forming method also needs 100 to 150 hours to degrease much amount of a binder used therefor. Resultantly, those two methods lower exceedingly an actual operation rate of a high investment cost apparatus capable of sintering and hot isostatic pressing. Consequently, the difficulties have partially solved, but still remain unsettled.

SUMMARY OF THE INVENTION

In the light of these circumstances, it is an object of the present invention to provide an apparatus for carrying out the three steps of drying or degreasing, sintering and hot isostatic pressing of a compact formed efficiently in one vessel system, allowing to employ not only the press forming method but also the casting or the plastic forming method.

To attain the object, in accordance with the present invention, an apparatus is provided for manufacturing a sintered body with high density comprising: a table having an object to be processed laid thereon; a pressure vessel accommodating a heat element heating said object around and a heat-insulating mantle surrounding the heat element; supply means for supplying to the pressure vessel an extractant which extracts a binder or a dispersion medium included in said object; exhaust means for exhausting the extractant and an extracted substance from the pressure vessel; pressure means for raising a pressure in the pressure vessel and vacuum means for evacuating the pressure vessel.

The above object and advantages will become apparent from the detailed description to follow, taken in conjunction with the appended drawing.

DESCRIPTION OF THE PREFERRED EMBODIMENT

Figure 1:
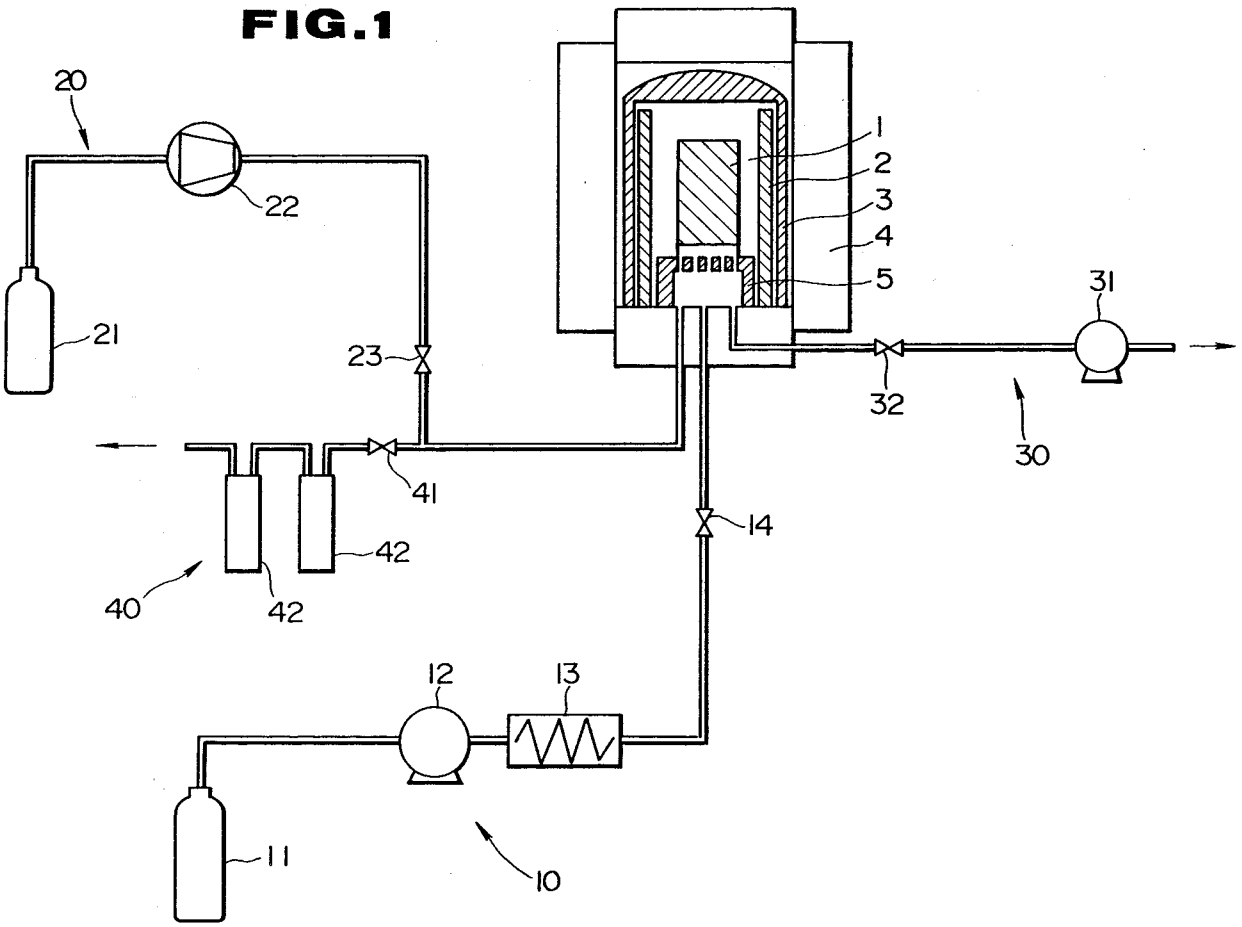
FIG. 1 is a schematic view showing an embodiment of an apparatus for manufacturing a sintered body with high density according to the present invention.

With specific reference to FIG. 1 of the drawing, an embodiment of the present invention will now be described. FIG. 1 schematically illustrates an embodiment of an apparatus for manufacturing a sintered body with high density according to the present invention.

Heat-insulating mantle 3 is set inside pressure vessel 4 and heat element 2 is set inside the heat-insulating mantle. At the inner side of the heat element, object 1 to be formed into a sintered body with high density is placed on table 5. The object is heated up to 600°–2,000° C. The object can be either a compact or a compact buried into powders filled in a crucible.

Furthermore, pressure vessel 4 is provided with supply means 10 for supplying to the pressure vessel an extractant to extract a binder or a dispersion medium included in object 1, pressure means 20 for raising a pressure in the pressure vessel, vacuum means 30 for evacuating the pressure vessel and exhaust means 40 for exhausting the extractant and an extracted substance from the pressure vessel. The extracted substance is at least one of the binder and the dispersion medium mainly contained in object 1.

Supply means 10 has extractant tank 11 for storing the extractant, pressure device 12 for giving a pressure to the extractant supplied from the extractant tank, temperature controller 13 for controlling a temperature of the extractant given the pressure by device 12 and extractant supply valve 14 supplying the pressured extractant with a temperature adjusted by controller 13. The temperature of the extractant is controlled between 30°–70° C., and the pressure of the extractant is kept between 75–200 kg/cm$^2$. Pressure means 20 has a gas cylinder 21 for storing gas to be sent to the pressure vessel, gas compressor 22 for giving a pressure to the gas supplied from gas cylinder 21 and pressure gas valve 23 for supplying the gas pressured by gas compressor 22. Vacuum means 30 has vacuum pump 31 for sucking gas in the pressure vesssel and vacuum valve 32 connecting the pressure vessel and the vacuum pump. Exhaust means 40 has separators 42 for separating the extractant and the extracted substance, which have been exhausted from the pressure vessel, and exhaust valve 41 to recover the extractant and the extracted substance independently.

Now, the work of this embodiment of the apparatus of the present invention will be explained.

As mentioned in the above prior art explanation, the casting method need not use the degreasing step, but in stead, the casting method removes, in the drying step, a dispersion medium existing in voids which are formed among grains in a compact. In this drying step, supply means 10 and exhaust means 40 are made use of to extract the dispersion medium and remove the same as carried out in the degreasing step in the plastic forming method. The steps following this drying step are basically the same with those carried out in the plastic forming method. Therefore, an application of the embodiment to the plastic forming method will be explained.

Firstly, material powders are put together with a binder mainly composed of wax into a kneader to be formed as pellets, and then, the pellets are taken out of the kneader. Those pellets are formed into a compact with a predetermined shape. The compact thus obtained is placed, as object 1 to be processed, on table 5 located at an inner position of heat element 2. The compact obtained at this stage contains 15 to 20% wax. A degreasing step is applied to the compact to remove the wax therefrom.

In the degreasing step, extractant supply valve 14 is firstly opened, and an extractant is released out of extractant tank 11. The extractant is given a pressure by means of pressure device 12 until the extractant reaches a predetermined pressure, and subsequently is heated upto a predetermined temperature by means of temperature controller 13, and then is supplied into the pressure vessel. When the inside pressure of pressure device 12 obtains the predetermined pressure, exhaust valve 41 is opened and pressure vessel 4 is degassed so that the inside of pressure vessel 4 is filled with the extractant. Subsequently, exhaust valve 41 is closed to increase a pressure of the pressure vessel and the extractant is formed into a fluid with the vicinity of a critical point. At the stage of this state, exhaust valve 41 is opened again, and the extractant, which has extracted wax contained in the compact, is decompressed by the opening of the exhaust valve. Then, the wax is now recovered through separators 42 and sent to exhaust gas treatment equipment (not shown).

In lapse of a predetermined time for extracting the binder contained in the compact, extractant supply valve 14 is closed. In the meantime, the extractant is exhausted until the inside pressure of pressure vessel 4 becomes almost equal to the atmospheric pressure, and then exhaust valve 41 is closed.

Subsequently, vacuum valve 32 is opened, and vacuum degassing is carried out by operation of vacuum pump 31. In the meantime, electric current is sent to heat element 2 to heat up object 1 to a predetermined temperature, whereby wax absorbed in the compact is removed. Now, the degreasing step is finished at this point and is followed by a sintering step.

The sintering is carried out by heating up the compact to a temperature suitable for the sintering. Depending on kinds of the compact, vacuum valve 32 is closed to stop the operation of vacuum pump 31 and gas is supplied from gas cylinder 21 to pressure vessel 4 so that the inside of the pressure vessel is arranged to have a pressure suitable for the sintering. And then, the sintering is carried out. Through this process, the compact has its density increased by contraction, whereby pores inside the compact linking one another change into ones independently isolated.

Next, a hot isostatic pressing step is carried out. Gas compressor 22 is started to send gas to pressure vessel 4 until an inside pressure of the pressure vessel reaches a predetermined pressure. And correspondingly, an inside temperature of the pressure vessel is raised to a predetermined temperature. The pressure vessel is kept at the predetermined pressure and the predetermined temperature to apply hot isostatic pressing to the compact, to thereby raise the density of the compact. After a predetermined time for the application of the pressure to the compact has passed, gas compressor 22 is stopped, and an electric current for heat element 2 is switched off to lower down the temperature to a predetermined temperature. Lastly, exhaust valve 41 is opened to exhaust gas, and the inside pressure of pressure vessel 4 is reduced to an ordinary pressure. Thus, the sintered body with high density which has been formed into from the compact is taken out.

According to the present invention, as described above, immediately after a compact is formed, the three steps of drying or degreasing, sintering and hot isostatic pressing of the compact can be carried out in one vessel without handling the compact outside the vessel.

Pressure device 12 for applying pressure to an extractant can be a diaphragm pump or a plunger pump. Temperature controller 13 for controlling a temperature of the extractant can be one of electric heating system or indirect heat exchange system using a heat medium such as steam.

As pressure vessel 4, a vessel having a maximum available pressure of 100 to 300 MPa is preferable. When the maximum available pressure is in a low range, a cover with bolt-fastening can be used. When the maximum available pressure is in a high range, a screw cover or a rubber-sealing cover is preferably hold down by means of a yoke frame.

Heat element 2 can be either of any one of metals such as molybdenum and tungsten or of any one of ceramics such as silicon carbide and graphite.

Heat-insulating mantle 3 is made of porous heat-insulating material.

Exhaust valve 41 can be a diaphragm valve or a needle valve.

Vacuum pump 31 can be a rotary pump or a rotary pump combined with a difusion pump. As gas compressor 22, a gas compressor of plunger type can be used, and its driving source can be oil or compressed air.

Material powders for a compact used as object 1 can be metal powders such as 2 wt.% Ni - 98 wt.% Fe and SUS 16, ceramic powders such as alumina, silicon carbide and zirconium or mixed powders of metal and ceramics such as W-Co.

Furthermore, most of dispersion mediums and binders existing in voids are required to be extracted by a fluid with the vicinity of the critical point. For example, when carbon dioxide is used as an extractant, teritial butyle alcohol, stearyl alcohol, stearic acid, methyl carbonate, or paraffin can be used as a dispersion medium. As an extractant, in addition to carbon dioxide, monochlorotrifluoromethane, dichlorodifluoromethane or ethylene can be used.

The apparatus of the present invention has advantages in that the three steps of drying or degreasing, sintering and hot isostatic pressing of a compact can be used in one vessel, and because of the apparatus being formed so as to enable degreasing or drying to be performed by a fluid having the vicinity of a critical point, the process of manufacturing a sintered body can be simplified and can be carried out efficiently in a short time.

What is claimed is:

1. An apparatus for use in manufacturing a sintered body having a high density, comprising:

(a) a pressure vessel including:

a table including means for receiving thereon an object to be processed;

a heating element for heating the object to be processed; and a heat-insulating mantle surrounding said heating element within the pressure vessel;

(b) extractant supply means for supplying an extractant, said extractant supply means including:

extractant pressure means for raising the extractant to a given pressure and for keeping the extractant at the given pressure; and temperature control means for keeping the extractant at a given temperature, said extractant pressure means and said temperature control means controlling said pressure and said temperature whereby the extractant turns into a fluid at a critical temperature and pressure point and in the vicinity of said critical point, the fluid extractant being capable of extracting an extracted substance included in the object, the extracted substance being at least one of a binder and a dispersion medium;

(c) exhaust means for exhausting the extractant and the extracted substance;

(d) pressure means for raising a pressure in said pressure vessel; and (e) vacuum means for evacuating said pressure vessel.

2. The apparatus of claim 1, wherein said pressure vessel has an available maximum pressure of 10 to 300 MPa.

3. The apparatus of claim 1, wherein said extractant supply means includes an extractant tank, and an extractant supply valve coupled to said extractant tank.

4. The apparatus of claim 1, wherein said extractant supply means includes means for supplying an extractant which is any one selected from the group consisting of carbon dioxide, monochlorotrifluoromethane, dichlorodifluoromethane and ethylene.

5. The apparatus of claim 1, wherein said extractant pressure means includes means for keeping a pressure of the extractant between 75 and 200 kg/cm$^2$, both inclusive.

6. The apparatus of claim 5, wherein said temperature control means includes means maintaining the temperature of the extractant between 30° to 70° C., both inclusive.

7. The apparatus of claim 1, wherein said temperature control means includes means maintaining the temperature of the extractant between 30° to 70° C., both inclusive.

8. The apparatus of claim 1, wherein said pressure means includes a gas cylinder and a gas compressor coupled to said gas cylinder.

9. The apparatus of claim 1, wherein said exhaust means includes a separator for separating the extractant and the extracted substance, and an exhaust valve, whereby a pressure is reduced in the pressure vessel and then, the extractant is exhausted to recover the extracted substance.

10. The apparatus of claim 1, wherein the extracted substance separated by said separator is a binder.

11. The apparatus of claim 1, wherein said heating element comprises any one selected from the group consisting of molybdenum, tungsten, graphite and silicon carbide.

12. The apparatus of claim 1, wherein said heat insulating material comprises a porous insulating material.

13. An apparatus for use in manufacturing a sintered body having a high density, comprising:

(a) a pressure vessel including:

a table including means for receiving thereon an object to be processed;

a heating element for heating the object to be processed; and a heat-insulating mantle surrounding said heating element within the pressure vessel the pressure vessel being capable of having an available maximum pressure of 10 to 300 MPa;

(b) extractant supply means for supplying carbon dioxide as an extractant, said extractant supply means including:

extractant pressure means for raising the extractant to a pressure range of between 75 and 200 $kg/cm^2$, both inclusive, and for keeping the extractant within said pressure range; and temperature control means for keeping the extractant within a temperature range between 30° and 70° C., both inclusive, said extractant pressure means and said temperature control means controlling said pressure and said temperature such that the extractant turns into a fluid at a critical temperature and pressure point and in the vicinity of said critical point, the carbon dioxide fluid extractant being capable of extracting an extracted substance included in the object, the extracted substance being at least one of a binder and a dispersion medium;

(c) exhaust means for exhausting the extractant and the extracted substance;

(d) pressure means for raising a pressure in said pressure vessel; and (e) vacuum means for evacuating said pressure vessel.

14. The apparatus of claim 13, wherein said pressure means includes a gas cylinder and a gas compressor coupled to said gas cylinder.

15. The apparatus of claim 11, wherein said exhaust means includes a separator for separating the extractant and the extracted substance, and an exhaust valve, whereby a pressure is reduced in the pressure vessel and then, the extractant is exhausted to recover the extracted substance.

16. The apparatus of claim 15, wherein the extracted substance separated by said separator is a binder.

* * * * *

UNITED STATES PATENT AND TRADEMARK OFFICE

CERTIFICATE OF CORRECTION

PATENT NO. : 4,850,575

DATED : July 25, 1989

INVENTOR(S) : NISHIO et al.

It is certified that error appears in the above-identified patent and that said Letters Patent is hereby corrected as shown below:

Column 6, line 52 (claim 10), "of claim 1" should read

--of claim 9--.

Column 8, line 11 (claim 15), "of claim 11" should read

--of claim 13--.

Signed and Sealed this

Sixteenth Day of April, 1991

*Attest:*

HARRY F. MANBECK, JR.

*Attesting Officer*

*Commissioner of Patents and Trademarks*